United States Patent [19]

Sudmann et al.

[11] 3,942,197

[45] Mar. 9, 1976

[54] SPLASH PARTITION

[75] Inventors: Jürgen Sudmann; Holger Wenzel, both of Oldenburg, Germany

[73] Assignee: Firma Justin Hüppe, Oldenburg, Germany

[22] Filed: Mar. 27, 1974

[21] Appl. No.: 455,221

[30] Foreign Application Priority Data

Dec. 7, 1973 Germany ..... 2360944

[52] U.S. Cl. ..... 4/149; 4/154

[51] Int. Cl.[2] ..... A47K 3/14

[58] Field of Search ..... 4/146, 148, 149, 154, 155, 4/173, DIG. 5; 49/409–411

[56] References Cited

UNITED STATES PATENTS

| | | | |
|---|---|---|---|
| 3,074,077 | 1/1963 | Taubman | 4/149 |
| 3,384,998 | 5/1968 | Abramson | 49/411 |
| 3,461,466 | 8/1969 | Weaver et al. | 4/149 |
| 3,500,481 | 3/1970 | McKwane | 4/149 |

*Primary Examiner*—Richard E. Aegerter
*Assistant Examiner*—Stuart S. Levy
*Attorney, Agent, or Firm*—Olson, Trexler, Wolters, Bushnell & Fosse, Ltd.

[57] ABSTRACT

A splash partition for a bath tub or shower having sliding doors guided by a top rail and a bottom rail, the latter comprising a box profile the upper profile of which is inclined, at least the top face or the outer face being extended inwardly or upwardly by a wall of a U-groove which is open at its lowest part, each element engaging in a groove by an upwardly extending guide member.

5 Claims, 5 Drawing Figures

SPLASH PARTITION

Figure 1:
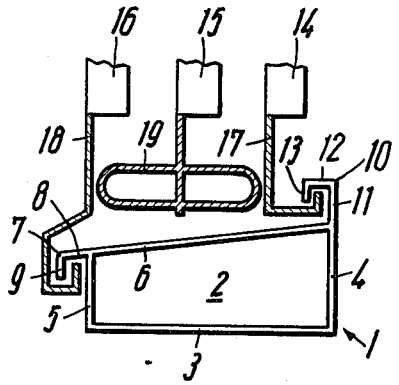

The invention refers to splash partitions for bath tubs or showers in the form of a sliding door of a number of elements movable horizontally in parallel planes, which are guided by running suspended from a headrail and on a footrail which consists of a hollow box profile with a top inclined towards the inside of the bath or shower and has projections running longitudinally which serve for guidance of the elements.

Sliding-door partitions of this kind are well known. In all these known bath tub or shower partitions the projections from the bottom guiderail which serve to guide the individual sliding doors at the bottom form cavities open at the top, into which water can penetrate. Consequently at the foot of the webs of the projections and thus directly at the inclined top of the hollow box profile, perforations must be provided in the webs whereby such water can drain inwards into the shower or bath tub; where the hollow box profile itself is open at the top, the perforations at the inside of the profile must be provided directly above the bottom of the profile.

Bottom guiderails of that kind are not only laborious and troublesome to clean but also unhygienic because soap residues, hair and dirt also get caught in the cavities with the water and settle when the water drains off. Blocking of the drain openings can come about from such deposits.

It is therefore the object of the invention to produce a bath tub or shower partition with a bottom guiderail which does not have these cleaning and hygiene problems.

In accordance with the invention there is provided a splash partition in the form of a sliding door of a number of elements movable horizontally in parallel planes, which are guided by running suspended from a headrail and on a footrail which comprises a hollow box profile with a top inclined towards the bath or shower and has projections running longitudinally which serve for guidance of the elements, the projections from the completely closed hollow box profile comprising at least one U-groove open at the bottom, which projects from one of the upper inner edges and upper outer edge of the hollow box profile, continues the respective face and is engaged by guide means fitted to the bottom of a door element which extends outwardly of the bath or shower and upwardly into the groove.

No water and hence no residues can collect in the guide grooves open at the bottom. Also the arrangement of the guide grooves in such a way that the cross-web of the U continues the inclined top of the hollow box profile or the outer arm of the U continues the outside of the hollow box profile does not lead to the formation of water-trapping grooves; on the contrary, water can flow away unimpeded over a U-groove of which the cross web extends the inclined surface and in the case of the outer U-groove whose outer arm extends the outside of the box profile, lies at the top of the hollow box profile incline and can only be reached by water travelling up the incline which will drain back again down that profile.

Guidance of the individual sliding door elements in the guide grooves of the new bottom guiderail can be effected in various ways. For example the arrangement in the case of sliding doors with three elements can be made so that the outer element is guided in an outer U-groove at the top of the inclined top of the box profile and the inner element in an inner U-groove, whilst the middle element is guided on the two other elements. One U-groove can however also have a number of tracks lying parallel side by side in each of which engages the guide member of one element.

Particularly preferred, however, is a form in which the guide members consist of narrow straps which carry slide-shoes at their free ends and in which the straps of different elements engage in the same U-groove, in which case in particular the outer and middle elements are guided in the outer U-groove and the inner element is guided in the inner U-groove.

Figure 2:
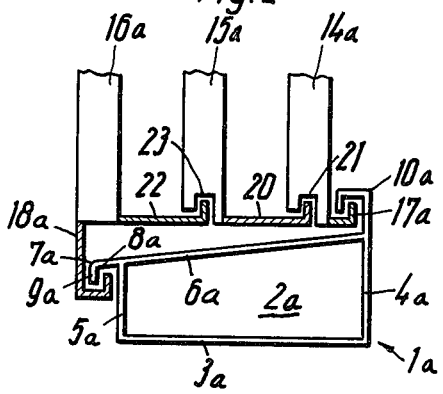
Figure 3:
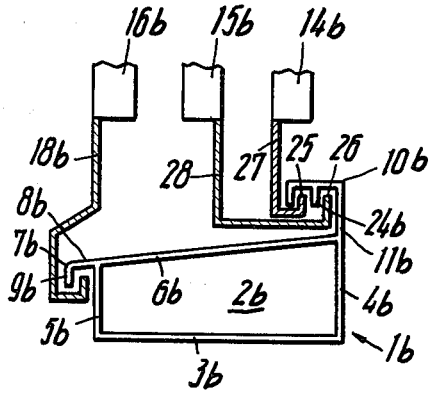
Figure 4:
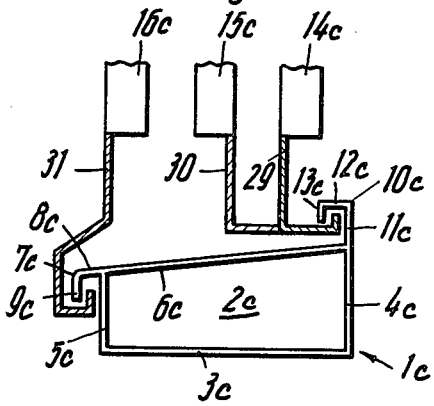
Figure 5:
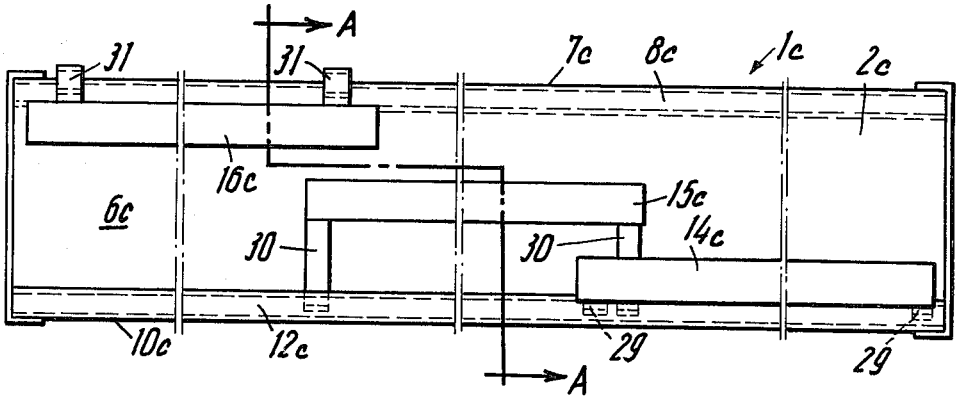

The accompanying drawings illustrate embodiments of the invention, given by way of example only, and in the drawings:

FIGS. 1 to 4 are diagrammatic cross-sections through the bottom guiderail as well as the guide members projecting from the bottom of the sliding door elements; and FIG. 5 is a partially sectioned plan of the arrangement illustrated in FIG. 4. The cross section of FIG. 4 is taken substantially along the line A—A in FIG. 5. FIGS. 1–3 are similar to FIG. 4, but showing different species.

In all the embodiments the bottom rail designated as a whole by 1 consists of a hollow box profile 2 completely closed all round, which has a bottom 3 for fastening to the edge of the tub, an outer face 4, an inner face 5 and a top 6 inclined towards the inner face 5. The top 6 continues inwards — out beyond the inner face 5 — in a U-groove 7 the cross-web 8 of which is a direct prolongation of the top 6 of the hollow box profile 2, and of which that arm 9 which is on the inside with respect to the sliding door, runs parallel with the inner face 5, which at the same time forms the other arm of the U-groove 7.

The outer face 4 of the hollow box profile 2 continues into that arm 11 of a second outer U-groove 10, which is on the outside with respect to the sliding door, and of which the cross-web extending horizontally inwards carries the other arm 13 of the U-groove 10, the free end of which leaves open a gap from the top face 6 of the hollow box profile.

On the underside of the sliding door elements 14 (outer element), 15 (middle element) and 16 (inner element) guide members are fastened which are formed differently in the several embodiments and which engage at their free ends in the U-grooves 7, 10 for the bottom guidance of the elements 14 to 16.

In the case of the example illustrated diagrammatically in FIG. 1 the guide members which are fastened to the outer element 14 and to the inner element 16 can be continuous rails 17 and 18 respectively, which are bent over at right angles so that the free edges of the rails (provided where necessary with slide-shoes or coatings) engage in the U-grooves 10 and 7 respectively. Against the guide members in the form of the rails 17, 18, the middle element 15 bears by means of a spacer 19 extending inwards and outwards, which in the contact zone can likewise be provided with slide shoes or coatings or consist respectively of altogether resilient material.

In the embodiment as in FIG. 2 similar parts are identified by similar numerals with the suffix *a* added. Thus, the guide members which here too may have the form of rails are, because of their similarity in spite of their different form, designated by 17*a* and 18*a*. The function of the spacer 19 in FIG. 1 is in accordance with FIG. 2 taken over on the one hand by a rail-shaped hook 20 on the middle element 15*a* which engages at its free end in a U-groove 21 in the underside of the outer element 14*a*, and on the other hand by a similar rail-shaped hook 22 which is fastened to the underside of the inner element 16*a* and engages in a U-groove 23 provided in the underside of the middle element 15*a*.

In the case of the embodiment in accordance with FIG. 3 similar parts are identified by similar numerals with the addition of the suffix *b* to avoid duplication of description. The outer U-groove 10*a* has two tracks 25 and 26 divided by an intermediate arm 24. In the track 25 runs a guide member 27 of the outer sliding door element 14*a*, which here too if necessary is rail-shaped, whilst in the track 26 a likewise rail-shaped guide member 28 of the middle element 15*b* is guided. The two rail-shaped guide members 27, 28 moreover overlap one another in the way clearly visible in FIG. 3. The inner element 16*b* is just as in FIG. 1 guided by means of a rail-shaped guide member 18*b* in the inner U-groove 7*b*.

In the case of the particularly preferred embodiment illustrated in FIG. 4 similar parts are identified by similar numerals with the addition of the suffix *c*. The outer element 14*c* and the middle element 15*c* are guided in the same outer U-groove 10*c*. For that reason the guide members have here the form of narrow guide members 29 and 30 respectively, which are arranged offset across the width of the doors so that upon opening the sliding doors they do not get in each others way (FIG. 5). Also the free ends of the guide members 29, 30 may be provided with coatings which in the diagrammatic illustration is not distinguished separately. Corresponding guide members 31 are also applied to the inner element 16*c*, shaped to correspond with the rails 18 and 18*b* in FIGS. 1 and 3, respectively (and if necessary they could, like these, also be continuous rails).

Finally it must be pointed out that the principle to be derived from FIGS. 4 and 5, of a number of elements mutually slidable in one U-groove 10*c* is also applicable to all three elements, although in that case not all of the elements (when it is a question of more than two) can be guided at (or close to) the ends at both edges.

The invention is claimed as follows:

1. A splash partition for a bath or shower comprising: first, second and third sliding doors for movable suspension from a head rail, a foot rail below said sliding doors, said foot rail comprising an inclined top surface descending from a first top outer edge downwardly toward the bath or shower to a second, lower inner edge, an upwardly projecting inverted U-shaped channel formed longitudinally along said first top outer edge and overlying and opening downwardly toward said top surface for drainage of water therefrom down onto said top surface, an inverted U-shaped channel formed longitudinally along said second lower inner edge and lying below said surface to allow free water run off into said tub or shower, said first door having a first guide member at the bottom thereof engageable with said upwardly projecting inverted U-shaped channel for guiding movement therealong, said second door having a second guide member at the bottom thereof engageable with said inverted U-shaped channel formed along said second, lower inner edge, and said third door having a third guide member at the bottom thereof for guiding said third door relative to at least one of said first and second doors and said foot rail.

2. A splash partition for a bath or shower as set forth in claim 1, and further including a third inverted U-shaped channel formed in the bottom of said first door for receiving said third guide member for guiding movement therealong.

3. A splash partition as set forth in claim 2 wherein the upwardly projecting inverted U-shaped channel receives the guide members of both said first and third doors.

4. A splash partition as set forth in claim 3 wherein said upwardly projecting inverted U-shaped channel comprises a double channel having two grooves respectively receiving the guide members of the first and third doors.

5. A splash partition for a bath or shower as set forth in claim 2, wherein said second door includes a fourth guide member, and a fourth inverted U-shaped channel in the bottom of said third door and and receiving said fourth guide member.

* * * * *